United States Patent [19]

Bosco

[11] Patent Number: 4,905,822

[45] Date of Patent: Mar. 6, 1990

[54] PACKAGING FRAME

[75] Inventor: Vandir Bosco, Sao Paulo, Brazil

[73] Assignee: Melplastic Industrial Ltd., Sao Paulo, Brazil

[21] Appl. No.: 293,674

[22] Filed: Jan. 5, 1989

[51] Int. Cl.[4] ..... B65D 25/00

[52] U.S. Cl. ..... 206/45.34; 206/45.31; 220/4 E; 220/84

[58] Field of Search ..... 206/45.34, 497, 457, 206/45.14, 45.31; 220/4 E, 84; 312/257 SK

[56] References Cited

U.S. PATENT DOCUMENTS

| | | | |
|---|---|---|---|
| 2,287,495 | 6/1942 | Moyers | 206/45.34 |
| 2,695,723 | 11/1954 | Waterman | 220/84 |
| 3,324,997 | 6/1967 | Bonanno | 206/45.34 |
| 3,406,816 | 10/1968 | Green et al. | 206/45.34 |
| 3,502,204 | 3/1970 | James | 206/45.34 |
| 4,143,764 | 3/1979 | Moss | 220/84 |
| 4,802,601 | 2/1989 | Pijanowski et al. | 220/4 E |

FOREIGN PATENT DOCUMENTS

| | | | |
|---|---|---|---|
| 1536311 | 1/1970 | Fed. Rep. of Germany | 220/4 E |

*Primary Examiner*—David T. Fidei
*Attorney, Agent, or Firm*—Cushman, Darby & Cushman

[57] ABSTRACT

The packaging frame includes two identical parts consisting of a peripherical rib of "L"-shaped cross-section forming a rectangular frame or any other geometrical configurations, provided with perpendicular extensions also of "L"-shaped cross-section and internally reinforced at the vertices for assembly and joining to each other by means of screws or by press-fitted pins.

4 Claims, 3 Drawing Sheets

PACKAGING FRAME

BACKGROUND OF THE INVENTION

The present invention relates to a frame for packaging, embodying a highly useful and functional product which presents various practical and efficient advantages in view of its individual and innovative features.

SUMMARY OF THE INVENTION

The frame is intended to change the concepts of packaging, replacing to advantage conventional packages of cardboard while presenting a simple solution by means of a novel package of various sizes and models which are intended at the same time to enhance the appearance of the packaged product.

The frame is completely transparent, allowing full view of its contents. It is dismountable and of easy assembly. Its form is very simple, providing economical industrialization with a consequent reduction in final costs. It is made of semi-rigid thermoplastic material of unlimited durability and possesses an enhancing decorative effect.

In order to clearly understand the form or shape of the subject packaging frame, the same is depicted in the attached illustrative drawings and which are referred to in this text in order to clarify the following detailed description, it being here emphasized that such drawings are herewith presented merely as explanatory or illustrative of the basic concept of the subject patent, without the intention of establishing limiting characteristics.

BRIEF DESCRIPTION OF THE DRAWINGS

In the Drawings:

FIG. 2 is a perspective view of the assembled frame.

FIGS. 3, 3*a* and 3*b* are fragmentary cross-sectional views on lines "A—A" and "B—B" of FIG. 2 showing two alternatives used for assembly of the frame.

DETAILED DESCRIPTION

Figures 1, 1A:
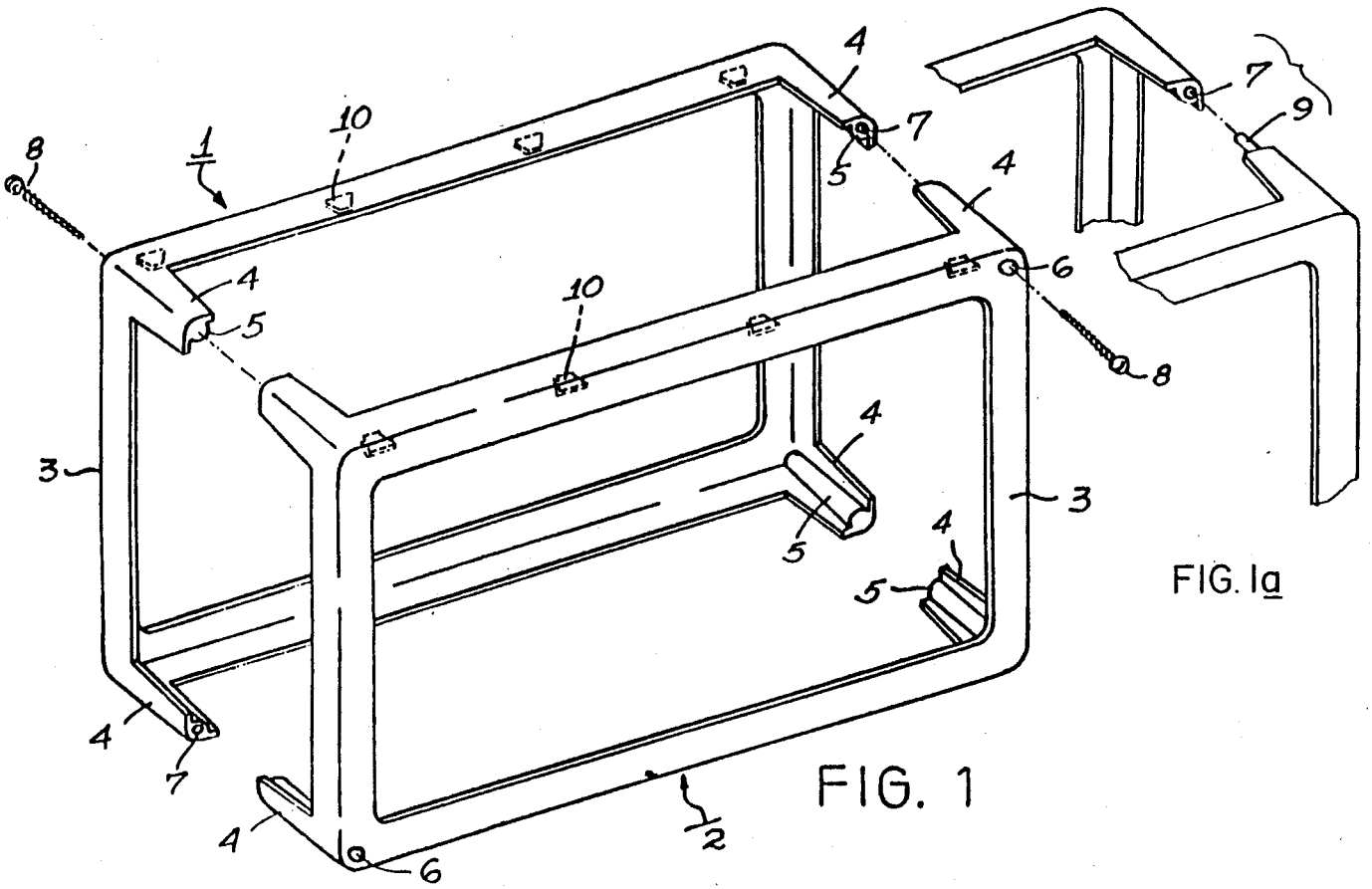
FIG. 1 is an exploded perspective view of the frame.
FIG. 1a is a detail of a variation of the method of assembly.

The packaging frame of the present invention is constructed in two parts (1) and (2) which can be coupled and joined together, each part consisting of a peripheral rib having an "L"-shaped transverse cross-section and which forms frame (3). Located at each of its corners and perpendicular to the frame are extensions (4), also of "L"-shaped transverse cross-section and provided with structural reinforcements of circular transverse cross-section (5). Two of these extensions (4) which are diagonally opposite, are provided with a hole (6) bored to a certain depth followed by a hole of smaller diameter through to the inner face of said extensions (4). Each of the remaining two extensions (4) are provided with a small hole at the inner end (7).

Figures 2, 3A, 3B, 3C:
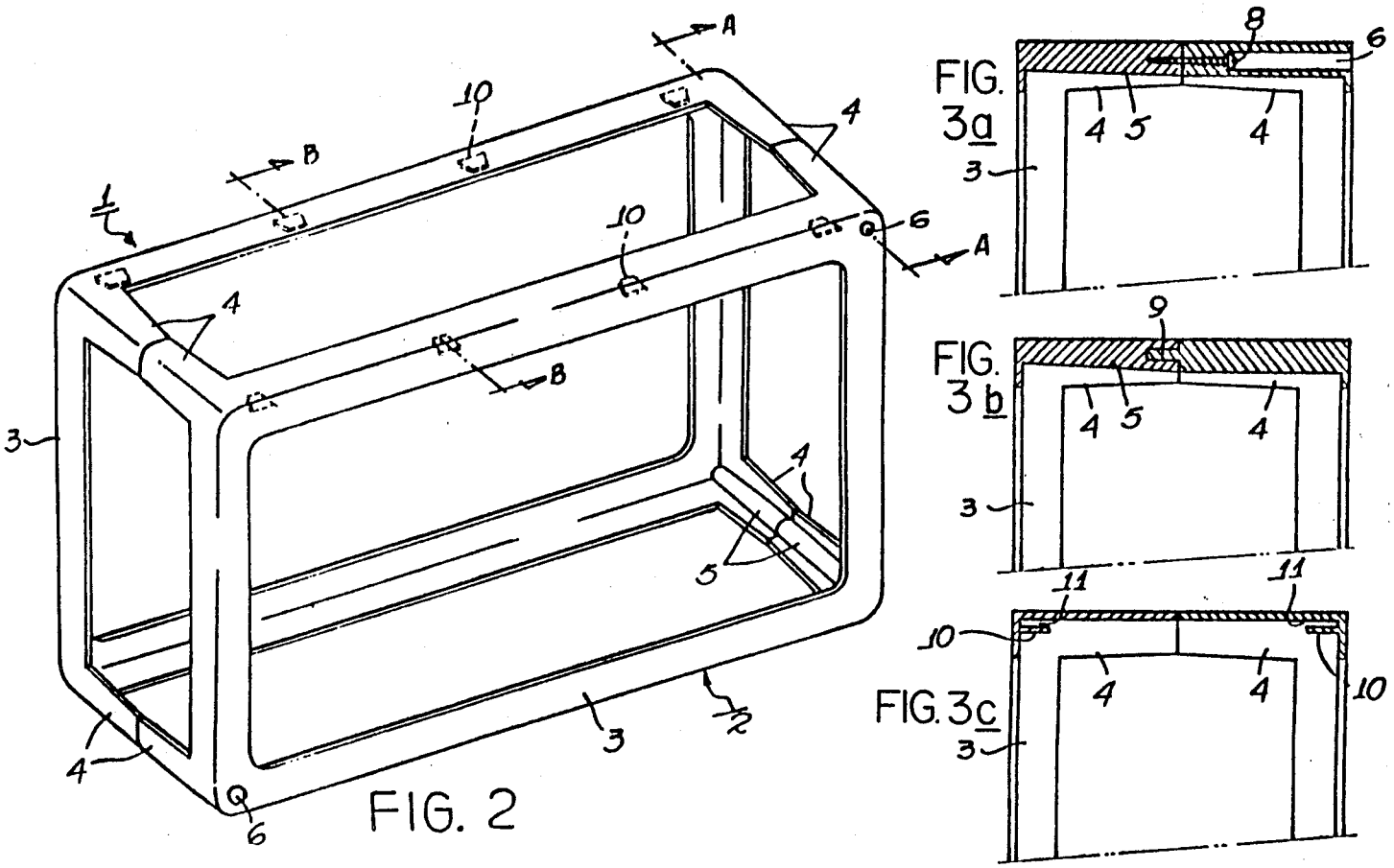

These two parts (1) and (2), components of the packaging frame, are assembled by joining the ends of extensions (4) and inserting screws (8) in holes (6) and tightening the screws into the smaller holes (7), as detailed in FIG. 3*a*.

As a constructive alternative mainly with respect to the method of joining the component parts (1) and (2), the two diagonally opposite extensions (4) can be provided with guide pins (9) to be pressed into the holes (7) can be seen in the other two extensions (4) as shown in the FIG. 1*a* and in FIG. 3*b*.

The internal side walls of the upper ribs of frame (3) are provided with small tabs (10) equally spaced at right angles to said side walls and millimetrically spaced from the inner top walls of said upper ribs, thus providing narrow slots (11) for the insertion of cards containing the trademark, name and other written matter pertinent to the packaged product.

Figure 4:
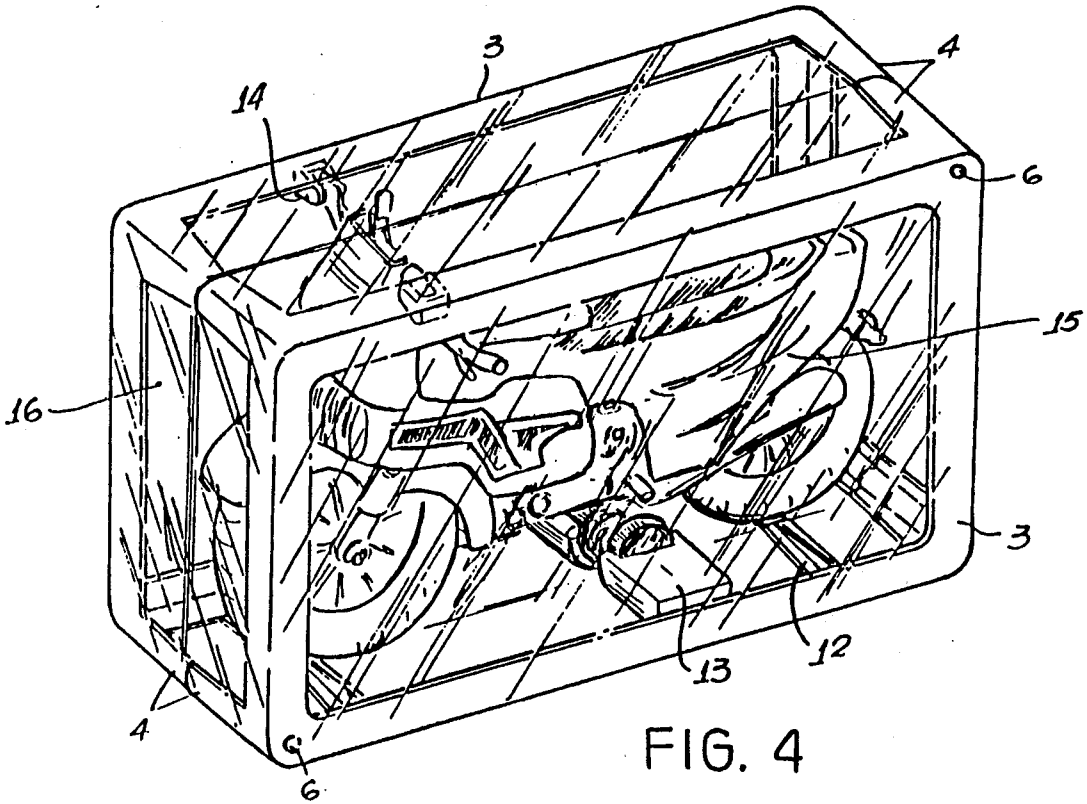
FIG. 4 is a perspective view showing, by way of example, the subject frame used for packaging a toy.

In order to conform to the product to be exhibited or packaged, the packaging frame can conveniently incorporate extra projections on frames (3), such as those projections (12), (13) and (14) shown in FIG. 4, which are to be used to support and secure the packaged toy, in this case, a motorcycle (15).

After the product is packed and the two component parts (1) and (2) of the packaging frame have been assembled, the package in question can be wrapped with a transparent plastic film (16), thus totally sealing said package, as can be seen in FIG. 4.

Due to the fact that the products to be packaged can be of diverse types and models, the subject packaging frame can be of different sizes and models to conform to the products, and can be of configurations different to that presented in the attached drawings (form of a parallelepiped), and be constructed in round, square, spherical or other geometrical configurations without reducing or impairing in any way the scope or object of the subject invention.

From the foregoing description, the technical, practical, functional and economic advantages provided by the subject packaging frame become evident in view of its individual and innovative characteristics and of its fundamental novelty features, thus uniting the necessary conditions to entitle it to the privilege of invention.

I claim:

1. A packaging frame, comprising:

a pair of substantially identical frame parts integrally molded of semi-rigid thermoplastic material;

each said frame part including a generally planar, open rectangular portion made of four elements integrally joined at four corners and each having an L-shaped transverse cross-sectional shape having two walls joined at a respective outer edge of the respective frame part;

each frame part further including four extensions each having one end integrally joined to a respective said rectangular portion at a respective corner so as to extend in a like direction perpendicular to the respective said frame portion;

each extension having another end; said pair of frame parts being arranged in confronting relation, so that said other ends of the frame portion abut respective of said other ends of the other said frame portion and respective said extensions having abutting ends thereby form extensions of one another;

each said extension having an L-shaped transverse cross-sectional shape having two walls joined at a respective outer edge of the respective extension;

each extension further having integrally formed where said two walls thereof join at an inside vertex, a reinforcement of generally circular transverse cross-sectional shape;

on two diagonally opposite edges of said packaging frame each formed by two respective ones of said extensions, such two extensions each being provided with fastener means which cooperate to secure such two extensions together;

one of said frame parts on two opposed ones of said elements of said rectangular portion thereof being provided on respective legs of said elements which extend substantially parallel to one another, with tab means which extend towards one another with slight spacing behind respective legs of said elements which extend in a common plane, thereby providing slot means which open towards one another.

2. The packaging frame of claim 1, wherein: said cooperating fastener means comprise respective recessed screws threaded into respective holes.

3. The packaging frame of claim 1, wherein:

said cooperating fastener means comprise respective pins press fit into respective holes.

4. The packaging frame of claim 1 further comprising:

projections integrally formed on said frame parts and projecting inwardly of the packaging frame for supporting and securing with respect to the packaging frame parts of a product when housed within said packaging frame.

* * * * *